US008001662B1

(12) United States Patent
Guber

(10) Patent No.: US 8,001,662 B1
(45) Date of Patent: Aug. 23, 2011

(54) CLIP DEVICE

(76) Inventor: Gary Guber, Boulder, CO (US)

( * ) Notice: Subject to any disclaimer, the term of this patent is extended or adjusted under 35 U.S.C. 154(b) by 484 days.

(21) Appl. No.: 12/286,416

(22) Filed: Sep. 30, 2008

Related U.S. Application Data

(60) Provisional application No. 61/066,715, filed on Feb. 21, 2008.

(51) Int. Cl.
*A44B 11/25* (2006.01)

(52) U.S. Cl. ..... 24/319; 24/313; 24/321; 24/586.1; 24/587.12; 24/DIG. 38

(58) Field of Classification Search ..... 24/586.1, 24/586.11, 587.1, 587.12, 589.1, 584.1, 312, 24/313, 319, 321, 165, 199, 265 H, 698.3, 24/DIG. 38, DIG. 42
See application file for complete search history.

(56) References Cited

U.S. PATENT DOCUMENTS

| | | | | |
|---|---|---|---|---|
| 2,893,094 | A * | 7/1959 | Heckethorn | 24/588.11 |
| 2,908,058 | A * | 10/1959 | Doorn | 24/21 |
| 3,080,635 | A * | 3/1963 | Alfred et al. | 24/588.11 |
| 3,520,033 | A * | 7/1970 | Usuda | 24/590.1 |
| 3,530,546 | A * | 9/1970 | Ferrando | 24/312 |
| 3,765,062 | A * | 10/1973 | Cruse | 24/587.12 |
| 4,052,774 | A * | 10/1977 | Noda | 24/587.12 |
| 6,484,372 | B2 * | 11/2002 | Novak et al. | 24/312 |
| 6,499,201 | B2 * | 12/2002 | Fildan et al. | 24/586.11 |

* cited by examiner

*Primary Examiner* — James Brittain
(74) *Attorney, Agent, or Firm* — Emery L. Tracy

(57) ABSTRACT

A clip device for releasably securing objects together is provided. The clip device comprises a clip body with a first slot formed in the clip body and a second slot formed in the clip body substantially parallel to the first slot. A cross member divides the first slot from the second slot. A faceplate substantially parallel to the cross member is formed in the clip body with the faceplate having a substantially planar front face surface and a rear face surface. A finger extends from the front face surface with the finger curling back toward the front face surface. An opening is formed through the faceplate wherein upon positioning of the front face surfaces of two adjacent clip bodies together, the finger is releasably receivable within the opening formed in the front faceplate.

19 Claims, 5 Drawing Sheets

CLIP DEVICE

The present application claims priority of provisional patent application Ser. No. 61/066,715, filed on Feb. 21, 2008, entitled "Clip Device".

BACKGROUND OF THE INVENTION

1. Field of the Invention

This invention relates generally to a clip device and, more particularly, the invention relates to a clip device using inner tubes or straps to releasably secure objects.

2. Description of the Prior Art

Hundreds of thousands of bicycle tubes are discarded every year by bicyclists due to wear or malfunction. Many of the tubes end up in landfills and dumps since other simple uses have not yet been discovered. It would be beneficial to be able to use the discarded bicycle tubes for other uses without further polluting the earth and contributing to the diminishing landfill capacity.

SUMMARY

The present invention is a clip device for releasably securing objects together. The clip device comprises a clip body with a first slot formed in the clip body and a second slot formed in the clip body substantially parallel to the first slot. A cross member divides the first slot from the second slot. A faceplate substantially parallel to the cross member is formed in the clip body with the faceplate having a substantially planar front face surface and a rear face surface. A finger extends from the front face surface with the finger curling back toward the front face surface. An opening is formed through the faceplate wherein upon positioning of the front face surfaces of two adjacent clip bodies together, the finger is releasably receivable within the opening formed in the front faceplate.

In addition, the present invention is a method for releasably securing objects together. The method comprises providing a clip body, forming a first slot in the clip body, forming a second slot in the clip body substantially parallel to the first slot, dividing the first slot from the second slot, forming a face plate substantially parallel to the cross member with the face plate having a substantially planar front face surface and a rear face surface, extending a finger extending from the front face surface, curling the finger back toward the front face surface, forming an opening through the face plate, positioning the front face surfaces of two adjacent clip bodies together, sliding the front face surfaces along each other until the fingers align with the openings, applying outward pressure on the clip bodies causing the fingers to be received within the openings, and releasably securing the clip bodies together.

The present invention further includes a clip device for releasably securing objects together. The clip device comprises a clip body with a first slot formed in the clip body and a second slot formed in the clip body substantially parallel to the first slot. A cross member divides the first slot from the second slot. A faceplate substantially parallel to the cross member is formed in the clip body with the faceplate having a substantially planar front face surface and a rear face surface. A finger extends from the front face surface with the finger curling back toward the front face surface. An opening is formed through the faceplate. A section of tubing is provided having a first end and a second wherein one of the ends of the tubing is insertable in an upward direction through the first slot closest to the face plate, wrappable around the cross member, and insertable in a downward direction through the second slot furtherest from the face plate. As the front faceplates of adjacent clip bodies are positioned against each other, the finger of each clip device curls behind the front faceplate of the adjacent clip body. As the front face surfaces are slid along each other, the fingers align with the apertures. Outward pressure on the clip bodies cause the fingers to be received within the openings thereby releasably securing the clip bodies together.

DETAILED DESCRIPTION OF THE PREFERRED EMBODIMENTS

As illustrated in FIGS. 1-4, the present invention is a clip device, indicated generally at 10, for releasably securing objects together. It should be noted that while the clip device 10 of the present invention will be described and illustrated herein as being used with discarded bicycle tubes 12, a person skilled in the art will understand that the clip device 10 can be used with other items including, but not limited to, straps (not shown).

Figure 1:
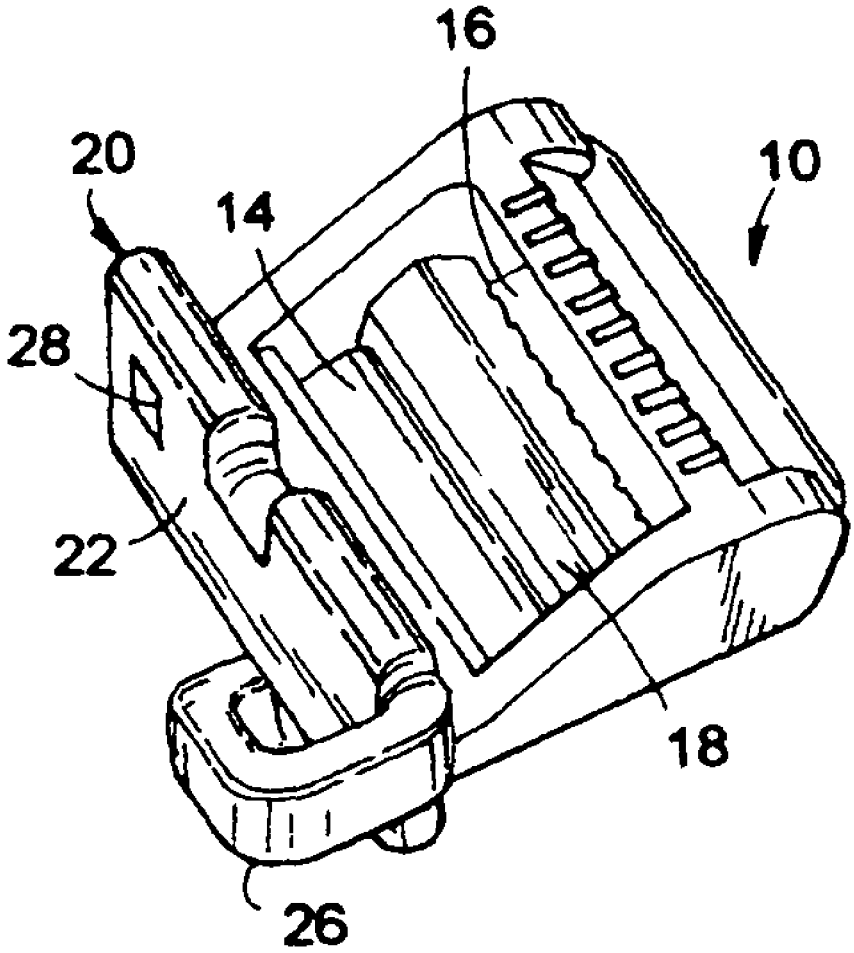
FIG. 1 is a perspective view illustrating a clip device, constructed in accordance with the present invention.
Figure 2:
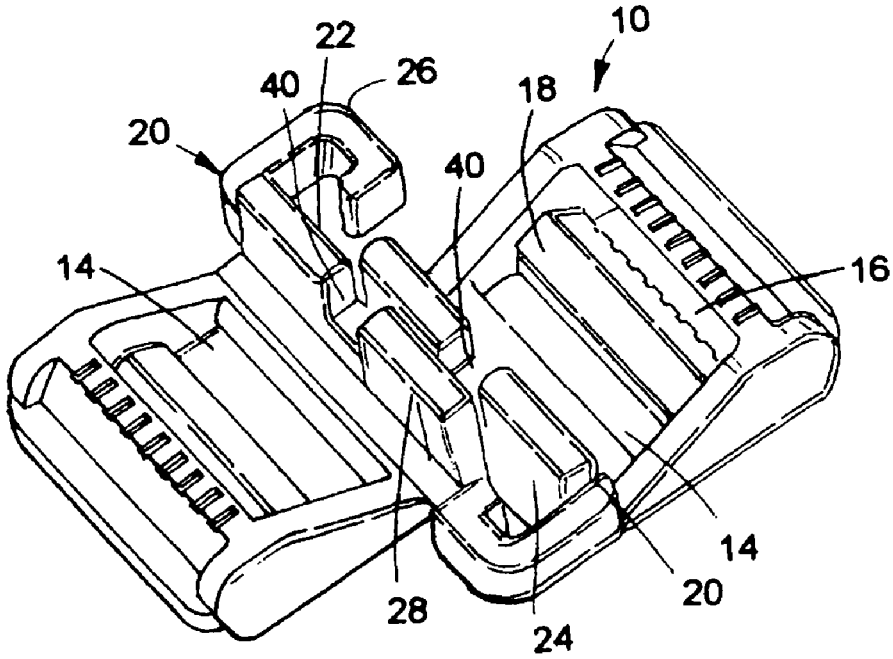
FIG. 2 is a perspective view illustrating the clip device, constructed in accordance with the present invention, prior to a pair of clip devices being releasably secured to each other.
Figure 3:
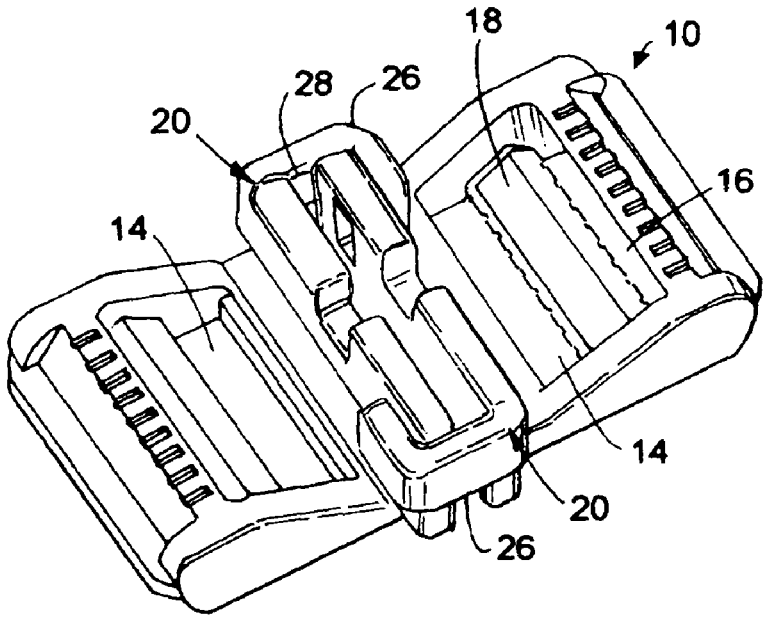
FIG. 3 is a perspective view illustrating the clip device, constructed in accordance with the present invention, with a pair of clip devices being releasably secured to each other.

The clip device 10 of the present invention, as best illustrated in FIGS. 1-3, includes a pair of slots, namely a first slot 14 and a second slot 16, divided by a cross member 18 for receiving the inner tube 12. Preferably the first slot 14 is substantially parallel to the second slot 16. Also, preferably, the cross member 18 is ribbed for extra gripping of the tube 12 when inserted into the slots 14, 16. It should be noted that while the cross member 18 is described and illustrated herein as being ribbed, it is within the scope of the present invention for the cross member 18 to either have different gripping mechanisms or be smooth, depending on the desires of the manufacturer and/or user.

In addition, the clip device 10 includes a faceplate 20 substantially parallel to the cross member 18. The faceplate 20 has a substantially planar front face surface 22 and a rear face surface 24. A finger 26 extends from the front face surface 22 and curls back toward the front face surface 22. The finger 26 is releasably receivable within an opening 28 formed in the faceplate 20 of an adjacent clip device 10 when in use. As the faceplates 20 of adjacent clip devices 10 are positioned against each other, the finger 26 of each clip device 10 curls behind the faceplate 20 of the adjacent clip device 10. Then, the user slides the front face surfaces 22 along each other until the fingers 26 align with the openings 28. Outward pressure on the clip devices 10 causes the fingers 26 to be received within the openings 28. Basically, when used in pairs, the clip device 10 is releasably secured to another clip device 10.

Figure 4:
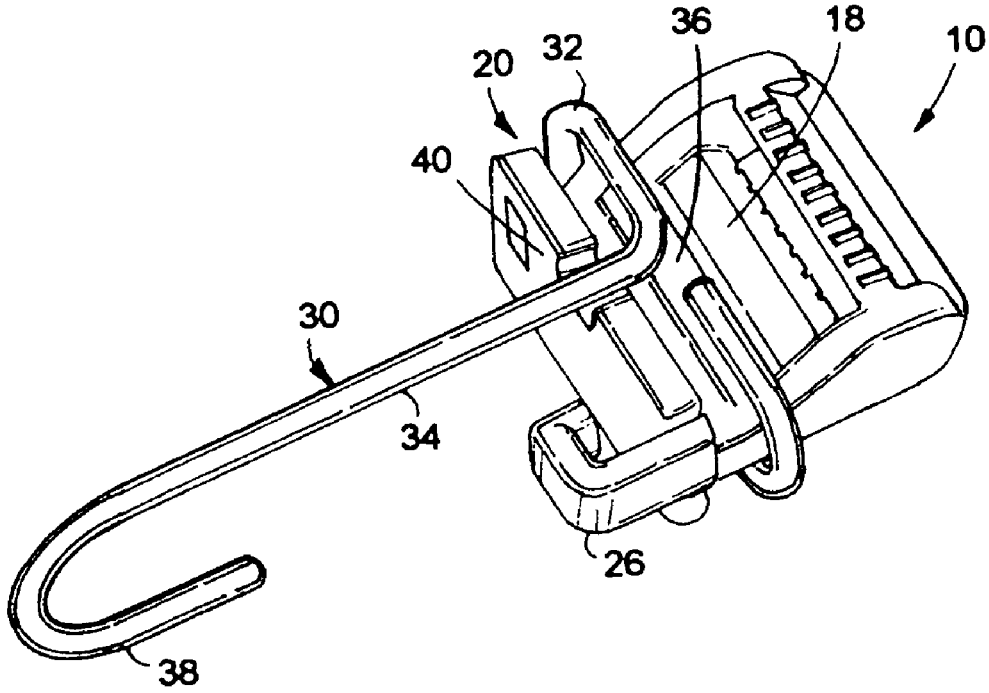
FIG. 4 is a perspective view illustrating a single clip device, constructed in accordance with the present invention, with a hook secured thereover.
Figure 5:
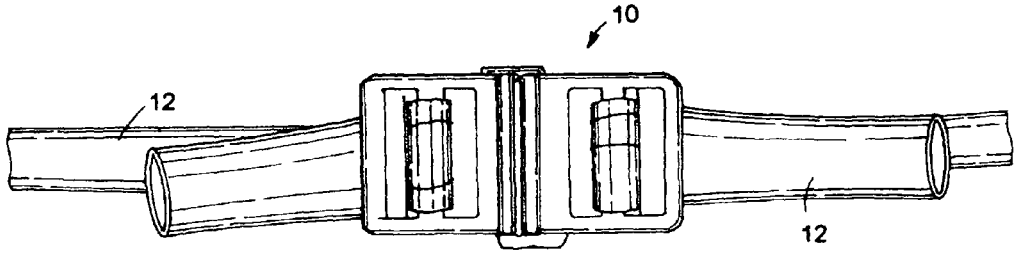
FIG. 5 is a perspective view illustrating a pair of clip devices, constructed in accordance with the present invention, with the tube inserted into the clip devices and the clip device releasably locked together.

Also, as best illustrated in FIG. 4, the clip device 10 of the present invention can include a hook 30 receivable over the clip device 10. The hook 30 for use with the clip device 10 is preferably formed from a single piece of wire stock. The hook 30 includes a substantially oval loop 32 with an extension member 34 extending from the oval loop 32. A small gap 36 is formed in the oval loop 32. A hook member 38 is formed at the other end of the extension member 34. The clip device 10 includes a notch 40 formed in the faceplate 20. When the hook 30 is positioned over the clip device 10, the extension member 34 is received within the notch 40. The hook 30 allows the clip device 10 to be used in a different manner, as will be described below.

The manner of use of the clip device 10 of the present invention will now be described. It will be understood by those skilled in the art that the manner of use of the clip device 10 described herein is merely one method of use and other methods of use of the clip device 10 are within the scope of the present invention.

Clip Devices Only:

First, the user cuts a section of the tubing 12 to the desired length. It should be noted that the length of the tubing 12 is adjustable when inserted into the clip device 12. Next, the user lays the tubing 12 flat insuring that the tubing 12 is not twisted. A clip device 10 is attached to each end of the cut tubing 12 by inserting the end of the tubing 12 in a generally upward direction into the first slot 14 adjacent the face plate 20, maneuvering the tubing 12 over the cross member 18, and inserting the tubing 12 in a generally downward direction into the second slot 16. It is important to leave at least one (1") inch of the end of the tubing 12 hanging out of the clip device 10 with the notch 40 facing in a generally upward direction. The user then confirms that each clip device 10 is firmly attached to the tubing 12 by holding tube approximately two (2") inches from the clip device 10 while holding the sides of the clip device 10. If the tubing 12 does not slip within the first slot 14 and the second slot 16, the clip device 10 is firmly attached to the tubing 12. Then, holding the sides of the two clip devices 10, the tubing 12 is stretched around the item to be secured and the clip devices 10 are attached together. As the faceplates 20 of the adjacent clip devices 10 are positioned against each other, the finger 26 of each clip device 10 curls behind the faceplate 20 of the adjacent clip device 10. Then, the user slides the front face surfaces 22 along each other until the fingers 26 align with the openings 28. Outward pressure on the clip devices 10 causes the fingers 26 to be received within the openings 28. Tubing sections 12 can be linked together using the clip devices 10 and secured by sliding a small piece of cardboard or a portion of the tubing 12 hanging out of the clip device 10 between the faceplates 20 of the adjacent clip devices 10.

Hooks Only:

In this manner, an uncut tubing 12 is used. First, the user insures that the tubing 12 is not twisted and does not have any significant imperfections that might cause the tube to break under tension. One edge of the tubing 12 is slid through the gap 36 formed in the oval loop 32 of a first hook 30. Then with the second hook 30 facing the opposite direction of the first hook 30, the tubing 12 is slid through the gap 36 in formed in the oval loop 32 of a second hook 30. The tubing 12 can now be used to tie down items in a truck bed, hang bicycles, etc., similar to other tie downs.

Clip Devices and Hooks:

First the user attaches a cut section of tubing 12 to the clip devices 10, as described above, making certain that the notch 40 is facing in a generally upward direction. With the hook member 38 of the hook 30 facing toward the clip device 10, the tubing 12 is slid into the gap 36 formed in the oval loop 32 of the hook 30. Holding the hook member 38 of the hook 30 the user pulls the hook 30 over the clip device 10 so that the hook 30 buts up against the rear face 24 of the clip device 10 and the extension member 34 of the hook 30 rests in the notch 40.

In an alternative embodiment, the hook 30 can be positioned over the front face surface 22 with the oval loop 32 maneuverably over the front face surface 22. In addition, in another alternative embodiment, the hook 30 can be positioned on the clip device 10, as described above, prior to the tubing 12 being secured to the clip device 10.

The clip device 10 of the present invention can inhibit hundreds of thousands of bicycle inner tubes from ending up in landfills every year. The clip device 10 has been created as a very practical and easy way to reuse tubing. Attaching a clip device 10 and/or hook to an intact bicycle tubing or a tubing cut to any length, and the user is able to tie down almost anything. Tube sections can be linked together with multiple clip devices 10 providing even more flexibility.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A clip device for releasably securing objects together, the clip device comprising:

a clip body;

a first slot formed in the clip body;

a second slot formed in the clip body, the second slot being substantially parallel to the first slot;

a cross member dividing the first slot from the second slot;

a faceplate substantially parallel to the cross member formed in the clip body, the faceplate having a substantially planar front face surface and a rear face surface;

a finger extending from the front face surface, the finger curling back toward the front face surface; and an opening formed through the faceplate;

wherein upon positioning of the front face surfaces of two adjacent clip bodies together, the finger is releasably receivable within the opening formed in the faceplate.

2. The clip device of claim 1 wherein the cross member is ribbed.

3. The clip device of claim 1 wherein as the faceplates of adjacent clip bodies are positioned against each other, the finger of each clip device curls behind the faceplate of the adjacent clip body.

4. The clip device of claim 3 wherein the front face surfaces are slid along each other until the fingers align with the openings.

5. The clip device of claim 4 wherein outward pressure on the clip bodies causes the fingers to be received within the openings thereby releasably securing the clip bodies together.

6. The clip device of claim 1 and further comprising:

a hook receivable over one of the clip bodies.

7. The clip device of claim 6 wherein the hook is formed from a single piece of wire stock.

8. The clip device of claim 6 and further comprising:

a notch formed in the faceplate;

wherein the hook has a substantially oval loop with an extension member extending from the oval loop, a gap is formed in the oval loop, and a hook member is formed at the other end of the extension member, the extension member receivable within the notch as the hook is positioned over the clip body.

9. The clip device of claim 1 and further comprising:

a section of tubing having a first end and a second end;

wherein one of the ends of the tubing is insertable in an upward direction through the first slot, wrappable around the cross member, and insertable in a downward direction through the second slot.

10. A method for releasably securing objects together, the method comprising:

providing a clip body;

forming a first slot in the clip body;

forming a second slot in the clip body substantially parallel to the first slot;

dividing the first slot from the second slot;

forming a faceplate substantially parallel to the cross member, the faceplate having a substantially planar front face surface and a rear face surface;

extending a finger extending from the front face surface;

curling the finger back toward the front face surface;

forming an opening through the faceplate;

positioning the front face surfaces of two adjacent clip bodies together;

sliding the front face surfaces along each other until the fingers align with the openings;

applying outward pressure on the clip bodies causing the fingers to be received within the openings; and releasably securing the clip bodies together.

11. The method of claim 10 and further comprising:

forming ribs on the cross member.

12. The method of claim 10 and further comprising:

positioning a hook over one of the clip bodies.

13. The method of claim 12 and further comprising:

forming the hook from a single piece of wire stock.

14. The method of claim 12 and further comprising:

forming a notch in the faceplate;

forming a substantially oval loop in the hook;

extending an extension member from the oval loop;

forming a gap in the oval loop;

forming a hook member at the other end of the extension member;

positioning the oval loop over the clip body; and positioning the extension member within the notch.

15. A clip device for releasably securing objects together, the clip device comprising:

a clip body;

a first slot formed in the clip body;

a second slot formed in the clip body, the second slot being substantially parallel to the first slot;

a cross member dividing the first slot from the second slot;

a faceplate substantially parallel to the cross member formed in the clip body, the faceplate having a substantially planar front face surface and a rear face surface;

a finger extending from the front face surface, the finger curling back toward the front face surface;

an opening formed through the faceplate; and a section of tubing having a first end and a second end;

wherein one of the ends of the tubing is insertable in an upward direction through the first slot, wrappable around the cross member, and insertable in a downward direction through the second slot; and wherein as the faceplates of adjacent clip bodies are positioned against each other, the finger of each clip device curls behind the front faceplate of the adjacent clip body;

wherein as the front face surfaces are slid along each other, the fingers align with the openings; and wherein outward pressure on the clip bodies cause the fingers to be received within the openings thereby releasably securing the clip bodies together.

16. The clip device of claim 15 wherein the cross member is ribbed.

17. The clip device of claim 15 and further comprising:

a hook receivable over one of the clip bodies.

18. The clip device of claim 17 wherein the hook is formed from a single piece of wire stock.

19. The clip device of claim 17 and further comprising:

a notch formed in the faceplate;

wherein the hook has a substantially oval loop with an extension member extending from the oval loop, a gap is formed in the oval loop, and a hook member is formed at the other end of the extension member, the extension member receivable within the notch as the hook is positioned over the clip body.

* * * * *